US012251071B2

(12) United States Patent
Heinle et al.

(10) Patent No.: US 12,251,071 B2
(45) Date of Patent: Mar. 18, 2025

(54) SYSTEM WITH A DISHWASHER, METHOD, AND COMPUTER PROGRAM PRODUCT

(71) Applicant: BSH Hausgeräte GmbH, Munich (DE)

(72) Inventors: Martin Heinle, Gundelfingen (DE); Daniel Miller, Finningen (DE); Martin Rittner, Welden (DE); Michael Rupp, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 10 days.

(21) Appl. No.: 17/924,126

(22) PCT Filed: May 19, 2021

(86) PCT No.: PCT/EP2021/063269
§ 371 (c)(1),
(2) Date: Nov. 9, 2022

(87) PCT Pub. No.: WO2021/239534
PCT Pub. Date: Dec. 2, 2021

(65) Prior Publication Data

US 2023/0180992 A1 Jun. 15, 2023

(30) Foreign Application Priority Data

May 25, 2020 (DE) ..... 102020206487.3

(51) Int. Cl.
*A47L 15/46* (2006.01)
*A47L 15/00* (2006.01)
*A47L 15/42* (2006.01)

(52) U.S. Cl.
CPC ..... *A47L 15/46* (2013.01); *A47L 15/0039* (2013.01); *A47L 15/0044* (2013.01);
(Continued)

(58) Field of Classification Search
CPC .. A47L 15/46; A47L 15/0039; A47L 15/0044; A47L 15/0047; A47L 15/0063;
(Continued)

(56) References Cited

U.S. PATENT DOCUMENTS 5,331,177 A * 7/1994 Kubisiak ..... G01N 21/532 250/575
5,731,868 A 3/1998 Okey
(Continued)

FOREIGN PATENT DOCUMENTS

DE 217557 A1 1/1985
DE 102018005896 A1 * 1/2020 ..... D06F 34/22
(Continued)

OTHER PUBLICATIONS

Schenkl, DE-102018005896-A1, Machine Translation. (Year: 2023).*
(Continued)

*Primary Examiner* — Duy N Deo
*Assistant Examiner* — Christopher Remavege
(74) *Attorney, Agent, or Firm* — Michael E. Tschupp; Andre Pallapies; Brandon G. Braun

(57) ABSTRACT

A system includes a dishwasher including a washing chamber, a sensor unit designed to detect a time curve of at least one sensor signal of a washing liquor and to output the detected time curve of the at least one sensor signal, a memory unit designed to store the time curve of the at least one sensor signal, an ascertaining unit designed to ascertain a temporal functional value based on the time curve of the at least one sensor signal, and a control device designed to carry out a washing program for washing washware in the washing chamber of the dishwasher and to carry out a specified action as a function of the temporal functional value.

17 Claims, 6 Drawing Sheets

(52) U.S. Cl.
CPC ..... *A47L 15/0047* (2013.01); *A47L 15/0063* (2013.01); *A47L 15/4297* (2013.01); *A47L 15/0057* (2013.01); *A47L 2401/10* (2013.01); *A47L 2401/12* (2013.01); *A47L 2401/30* (2013.01); *A47L 2501/30* (2013.01); *A47L 2501/34* (2013.01)

(58) Field of Classification Search
CPC ..... A47L 15/4297; A47L 15/0057; A47L 2401/10; A47L 2401/12; A47L 2401/30; A47L 2501/30; A47L 2501/34; A47L 2401/023; A47L 2401/11; A47L 15/0021; A47L 2401/04; A47L 2401/22; A47L 15/0026
See application file for complete search history.

(56) References Cited

U.S. PATENT DOCUMENTS

2004/0118435 A1 6/2004 Jung
2006/0162746 A1* 7/2006 Kuran ..... A47L 15/0002 134/25.2
2006/0216217 A1* 9/2006 Chan ..... G01N 33/1853 422/218
2009/0056757 A1* 3/2009 Son ..... A47L 15/0044 134/57 D
2010/0229901 A1* 9/2010 Rieger ..... A47L 15/0021 134/56 D
2010/0263687 A1* 10/2010 Braun ..... A61L 2/18 134/18
2011/0056520 A1 3/2011 Varacins
2011/0114132 A1* 5/2011 Padtberg ..... A47L 15/0049 134/25.2
2011/0126869 A1 6/2011 Heisele
2012/0298146 A1* 11/2012 Padtberg ..... A47L 15/0049 134/124
2014/0077828 A1* 3/2014 Gruden ..... G01N 33/182 324/693
2016/0309981 A1* 10/2016 Dirschus ..... A47L 15/0049
2017/0145612 A1* 5/2017 Zattin ..... D06F 33/47
2020/0281437 A1* 9/2020 Fallert ..... B08B 3/08
2021/0076898 A1* 3/2021 Smith ..... A47L 15/0028
2021/0127939 A1* 5/2021 Hofmann ..... A47L 15/0047

FOREIGN PATENT DOCUMENTS

JP H0759715 A 3/1995
JP 2008220658 A 9/2008

OTHER PUBLICATIONS

National Search Report DE 102020206487.3 dated May 10, 2021.
International Search Report PCT/EP2021/063269 dated Aug. 20, 2021.

* cited by examiner

SYSTEM WITH A DISHWASHER, METHOD, AND COMPUTER PROGRAM PRODUCT

The present invention relates to a system with a dishwasher, to a method and to a computer program product.

In dishwashers it can be problematic that the dishwasher, in particular components conducting the washing liquor, such as a circulating pump, a spray arm, a basket or even an interior of a dishwasher cavity, become soiled over time. In this case, for example, a layer of dirt can be formed on or in these components which can impair a cleaning performance of the dishwasher. Machine care programs are known as a countermeasure therefor. In known dishwashers, these machine care programs are started, in particular, after a predetermined number of washing program cycles has been carried out. This takes place, however, irrespective of the actual degree of soiling of the dishwasher. Thus it arises that the machine care program is started too early or even too late. In the one case, therefore, unnecessary energy, detergent and water is consumed and in the other case a cleaning performance of the dishwasher can already be noticeably impaired when the machine care program is started. Moreover, in this case it can lead to a premature ageing of components or the failure of functional units which are affected by the dirt.

DE 10 2008 040 647 A1 describes a dishwasher in which, when a start signal is present, a separate cleaning program is carried out for cleaning the dishwasher cavity, in particular by applying washing liquid. DE 10 2008 040 650 A1 describes a dishwasher in which a separate washing cycle is carried out at a higher temperature after a predetermined number of washing cycles and/or as a function of process parameters of previous washing cycles.

Against this background, an object of the present invention is to improve the operation of a dishwasher.

According to a first aspect, a system is proposed with a dishwasher, preferably a household dishwasher, comprising a control device for carrying out a washing program for washing items to be washed arranged in a washing chamber of the dishwasher, a sensor unit for detecting a time curve of at least one sensor signal of a washing liquor which serves for washing the items to be washed and for outputting the detected time curve of the at least one sensor signal, a memory unit for storing the time curve of the at least one sensor signal and an ascertaining unit for ascertaining a temporal functional value on the basis of the time curve of the at least one sensor signal. The control device is designed to carry out a specified action as a function of the ascertained temporal functional value.

This system has the advantage that the operation of the dishwasher is improved since not only individual measurement values of sensors are considered in order to control the dishwasher but the development of the sensor signal over time is also considered. For example, a prewash can be terminated in the course of a washing program if a turbidity of the washing liquor only changes slowly, while the turbidity overall is high. Moreover, long-term trends, such as the soiling of the dishwasher increasing slowly and over a plurality of washing program cycles, can be identified by the continuous detection and storage of the sensor signal and corresponding measures can be undertaken, in particular a machine care program or cleaning program can be carried out, for example, in a targeted manner.

The control device or the ascertaining unit can be implemented in each case in terms of hardware technology and/or software technology. In the case of an implementation in terms of hardware technology, the control device or the ascertaining unit can be configured, for example, as a computer or as a microprocessor. In the case of an implementation in terms of software technology, the control device or the ascertaining unit can be configured as a computer program product, as a function, as a routine, as part of a program code or as an executable object. The ascertaining unit can be part of the control device but can also be arranged externally to the dishwasher.

The sensor unit can comprise one or even a plurality of sensors which in each case detect a sensor signal of the washing liquor. The sensor signal refers in this case to a physical, chemical and/or biological parameter of the washing liquor, such as for example a turbidity, a conductivity, a water hardness, a temperature and the like. The sensor signal in this case is indicative of a value of the respective parameter. Hereinafter, the value of the respective parameter is denoted by the term sensor signal, i.e. the sensor signal of a temperature sensor is for example 50° C. A plurality of sensors can be provided for the same parameter, said sensors being arranged, for example, at different positions in the dishwasher where they are in contact with the washing liquor.

The sensor unit detects the at least one sensor signal in a specific time interval, preferably repeatedly, for example at a frequency of greater than 0.5/min, preferably greater than 1/min, more preferably greater than 2/min, even more preferably greater than 6/min. Preferably, the sensor unit detects the sensor signal regularly and/or periodically, preferably with a period length of less than 100 s, preferably less than 60 s, more preferably less than 30 s, even more preferably less than 10 s.

A time curve of the sensor signal in the present case is understood to mean, in particular, that sensor signals detected sequentially over time are stored in a time series, in particular with a time stamp. The time stamp in this case can represent an absolute time, but preferably the time stamp refers to a start time of the washing program cycle or to a switch-on time of the dishwasher. The time curve of the sensor signal is present, for example, as a table, wherein the corresponding time stamp is assigned to one respective value of the sensor signal.

The memory unit is configured, for example, as a data memory, such as a flash memory. The memory unit can be configured as a separate device but can also be a constituent part of the sensor unit, the ascertaining unit or the control device.

In the present case a temporal functional value is understood to mean, in particular, a value derived from the time curve. For ascertaining the temporal functional value, for example, at least two of the stored values are used, preferably two directly successive values, more preferably the entire time curve is used. Examples of the temporal functional value comprise a derivative of the sensor signal according to the time or an integration of the sensor signal over time. When ascertaining the temporal functional value, it is possible to use weightings which are time-dependent and/or dependent on the sensor signal value, for example the first minute of the time curve can be weighted to a greater or lesser extent than the further time curve and/or sensor signal values which are above a specific threshold value can be weighted to a greater or lesser extent than the sensor signal values which are below the threshold value, and the like.

The specified action which the control device carries out comprises, for example, the adaptation of a washing program parameter, the termination of a sub-program step, the output of an instruction to a user of the dishwasher, the setting of a status indicator and the like.

For example, the control device compares the ascertained temporal functional value with a specified threshold value or a functional value of a specified function, wherein the argument for ascertaining the functional value of the specified function depends, for example on a time interval, which forms the basis of the ascertained temporal functional value.

The proposed system thus differs, in particular, from such systems in which a monitoring or control is carried out merely on the basis of the current value of the sensor signal.

According to one embodiment of the system, the sensor unit comprises a turbidity sensor for detecting a turbidity of the washing liquor, preferably an optical turbidity sensor, and/or a conductivity sensor for detecting a conductivity of the washing liquor, preferably a spectroscopic impedance sensor, and/or a temperature sensor for detecting a temperature of the washing liquor.

In embodiments, the sensor unit further comprises a water hardness sensor for detecting a water hardness, a soiling sensor for detecting soiling of the items to be washed, in particular a chemical composition of the soiling, a load sensor for ascertaining a loading of the dishwasher and/or a detergent sensor for ascertaining a type of detergent.

For each of these sensors, the sensor unit is designed to detect the time curve of the sensor signal and the ascertaining unit is designed to ascertain the respective temporal functional value. The control device is designed to carry out the specified action where appropriate as a function of each of the plurality of temporal functional values.

According to a further embodiment, the sensor unit comprises a turbidity sensor for detecting the turbidity of the washing liquor, preferably an optical turbidity sensor, a conductivity sensor for detecting the conductivity of the washing liquor, preferably a spectroscopic impedance sensor, and a temperature sensor for detecting the temperature of the washing liquor.

In this embodiment, the sensor unit comprises at least the three aforementioned sensors. Accordingly, at least three time curves are stored, and the ascertaining unit ascertains one respective temporal functional value for each of the three time curves. The control device is designed to carry out the specified action as a function of each of the three temporal functional values.

This has the advantage that a correlation between the different sensor signals can be ascertained and/or that a more complex analysis can be carried out by the control device in order to carry out the specified action. For example, it can be provided that at least two of the three temporal functional values are above one respective threshold value or the sum of the three temporal functional values is compared with a threshold value and the like.

According to a further embodiment of the system, the sensor unit additionally comprises a filter soiling sensor which is designed to detect a degree of soiling of a filter arranged in the dishwasher and to output the detected degree of soiling as a further sensor signal.

The memory unit is designed to store a time curve of the further sensor signal and the ascertaining unit is designed to ascertain a further temporal functional value on the basis of the time curve of the further sensor signal.

The filter soiling sensor comprises, for example, a function which monitors a pump flow when the washing liquor is pumped out of the dishwasher. If the pump flow drops just after the start of the pumping action when the washing liquor is not yet completely pumped out, and after a short pumping pause is initially high again, so as to drop rapidly again, this is an indication that the filter is soiled and should be cleaned. This is because, when the filter is clean, the washing liquor flows into the sump as rapidly as it is pumped out. If the filter is soiled, however, the washing liquor is pumped out more rapidly from the sump than it can flow in, so that the load of the pump and thus the pump flow drops, but it is high again after a short waiting period as soon as the washing liquor has flowed in.

If the filter is soiled, for example, a filter cleaning program can be carried out as a specified action and/or the user of the dishwasher is requested to clean the filter manually.

According to a further embodiment of the system, the ascertaining unit is designed to integrate the time curve of the at least one sensor signal to ascertain an integral value, wherein the control device is designed to carry out a specified action as a function of the ascertained integral value.

In this embodiment, the integral value corresponds to the temporal functional value. The integral can refer to the entire time curve during a washing program cycle but can also be limited to sub-sections thereof, such as for example a heating phase or the like.

In embodiments, it is provided that the ascertaining unit compares the integral value with a threshold value and outputs a comparison result, wherein the control device is designed to carry out the specified action as a function of the comparison result.

According to a further embodiment of the system, the sensor unit comprises at least two of a turbidity sensor, a conductivity sensor, a temperature sensor and a filter soiling sensor, wherein the ascertaining unit is designed to integrate the respective time curve of the at least two sensor signals and to ascertain a key figure on the basis of the at least two integral values, wherein the control device is designed to carry out a specified action as a function of the ascertained key figure.

The key figure depends, in particular, on all of the at least two integral values, for example the key figure is a sum or a product of the at least two integral values. In this case, an individual weighting factor can be provided for each of the at least two integral values. Since the integral values in this example correspond to a temporal functional value, it can also be said that the key figure is a function of the temporal functional values.

According to a further embodiment of the system, the ascertaining unit is designed to differentiate the time curve of the at last one sensor signal to ascertain the differential value, wherein the control device is designed to carry out the specified action as a function of the differential value.

In this embodiment, the differential value corresponds to the temporal functional value.

According to a further embodiment of the system, the ascertaining unit is designed to ascertain a washing program functional value as a function of the stored time curve of the at least one sensor signal for a washing program cycle, to store the washing program functional value and to ascertain a curve of the washing program functional value on the basis of the washing program functional value over a plurality of washing program cycles, wherein the control device is designed to carry out the specified action as a function of the ascertained curve of the washing program functional value.

This embodiment is particularly advantageous since in this manner long-term changes can be ascertained and corresponding measures taken. In particular, statistics can also be ascertained about the influence of different washing program parameters. For example, it can be ascertained that a filter soiling rapidly increases with the use of a specific detergent, wherein a higher washing liquor temperature is set as a countermeasure therefor.

In the present case, the washing program functional value is understood to mean, in particular, a value which is ascertained on the basis of the time curve of the sensor signal for carrying out a washing program. For example, the washing program functional value can be the integral of the sensor signal curve from a start time of the washing program to an end time of the washing program, or an average value of the time derivative when carrying out the washing program.

The curve of the washing program functional value is ascertained, in particular, on the basis of a sequence of the washing program functional value over a plurality of washing program cycles, for example as a function of the plurality of washing program functional values. An example thereof is the sum of the washing program functional values which have been ascertained over a plurality of washing program cycles since the curve was last reset.

For example, a model for ascertaining when a machine care program or a machine cleaning program should be carried out can be implemented on the basis of the curve of the washing program functional value. For example, the value of a turbidity sensor is proportional to a quantity of dirt released in the washing liquor. The integral of the time curve of the turbidity sensor value thus corresponds, for example, to the quantity of dirt which the dishwasher has cleaned in a washing program cycle. The curve of the washing program functional value, for example, is ascertained as the sum of the quantities of dirt of washing program cycles carried out in succession, resulting in a total quantity of dirt which has been cleaned by the dishwasher. The components of the dishwasher are all the more likely to be soiled, the greater the quantity of dirt. Thus the total dirt quantity is compared, for example, with a threshold value and when the threshold value is exceeded, a machine cleaning program is carried out.

A further example is based on a conductivity sensor, the value thereof being proportional to the active detergent released in the washing liquor. "Active detergent" is understood to mean, for example, detergent which has not yet been used to release the dirt. The lower the value, the higher the probability that components of the dishwasher are soiled. For example, a sum of the reciprocal value of the integral of the time curve of the conductivity of a respective washing program cycle, which is an indication when a machine cleaning program has to be carried out, is ascertained as the curve of the washing program functional value. If the curve of the washing program functional value ascertained in this manner exceeds a specified threshold value, a machine cleaning program is carried out.

A further example is based on a temperature sensor which detects the temperature of the washing liquor. If a large quantity of items to be washed are arranged in the washing chamber, then the heating of the washing liquor takes longer at constant heating power. The time integral of the curve of the washing liquor temperature from the start of a heating phase up to the end of the heating phase, when for example a predetermined target temperature is reached, therefore, is proportional to a total heat capacity or thermal mass of the items to be washed heated by the washing liquor. Since the baskets and the washing chamber wall are also heated up therewith, a reference measurement can be carried out when the washing chamber is empty, the value thereof being subtracted from the ascertained value, for example. Moreover, a fluctuation in a mains voltage or the like, which has an effect on the heat output of a washing liquor heater, can be considered here. In this manner, for example, the washing program functional value of a washing program cycle is ascertained. A curve of the washing program functional value is obtained by adding up the washing program functional values of the washing program cycles successively carried out.

The greater the thermal mass, the more items to be washed are arranged in the washing chamber and the greater the quantity of dirt or the dirt load of the dishwasher to be anticipated. The curve of the washing program functional value thus develops according to a quantity of items to be washed which have been cleaned by the dishwasher, which is an indication of when, for example, a machine care program is required. If the curve of the washing program functional value exceeds a specified threshold value, a machine cleaning program is carried out.

In embodiments, the ascertaining unit is designed to store a plurality of time curves of the at least one sensor signal which have been detected and stored when carrying out different washing program cycles lying temporally in the past.

On the basis of the plurality of stored time curves of the sensor signal, it is possible to infer the influence of the different washing program parameters, for example by means of statistics, on the curve of the sensor signal and thus indirectly on the variables correlated with the sensor signal.

According to a further embodiment of the system, the sensor unit comprises at least two of a turbidity sensor, a conductivity sensor, a temperature sensor and a filter soiling sensor, wherein the ascertaining unit is designed to ascertain the respective washing program functional value as a function of the stored time curve of the respective signal of the at least two sensor signals for a washing program cycle, to store the respective value of the at least two washing program functional values and to ascertain a statistic on the basis of the respective curve of the at least two washing program functional values over a plurality of washing program cycles, wherein the control device is designed to carry out the specified action as a function of the ascertained statistic.

The statistic can be ascertained, for example, as a sum or a product of the washing program functional values, preferably with in each case an individual weighting. The ascertained statistic is compared, for example, with a specified threshold value and when the statistic exceeds the specified threshold value, a machine cleaning program is carried out.

For example, the dishwasher has a turbidity sensor, a conductivity sensor, a temperature sensor, and a filter soiling sensor. The statistic can be ascertained, for example, according to the following equation (1):

$$a.\ MZ=a\cdot T+b\cdot L+c\cdot H+d\cdot N+e\cdot D \qquad \text{Equation (1)}$$

In the equation (1) MZ stands for the statistic, T is the washing program functional value of the turbidity sensor signal, L is the washing program functional value of the conductivity sensor signal, H is the washing program functional value of the temperature sensor signal, N is the number of washing programs carried out since the last machine cleaning program was carried out, D is the washing program functional value of the filter soiling sensor signal and a, b, c, d and e are individual weighting parameters for the different washing program functional values. If MZ exceeds a specified threshold value, a machine care program is carried out.

According to a further embodiment, the control device is designed to carry out a machine care program and/or a filter cleaning program as a function of the temporal functional value and/or the curve of the washing program functional value.

According to a further embodiment, the control device is designed to adapt the current washing program, in particular for shortening a sub-program step of the current washing program, as a function of the temporal functional value.

A sub-program step is, for example, a soaking, a prewash, a main wash, a rinsing with rinse aid and/or a drying. This embodiment is advantageous since, for example, it can be ascertained on the basis of the time curve of the turbidity sensor signal that no more additional dirt is released in the washing liquor. For example, in this case the temporal functional value is ascertained as a differential value on the basis of the time curve which corresponds to the rate of change of the turbidity sensor signal. This is an indication that the items to be washed are clean. As a specified action, the main wash sub-program step can then be terminated which saves time and energy. Further temporal functional values such as those of the conductivity sensor or the temperature sensor can also be considered. If the conductivity sensor signal is very low, this indicates that insufficient active detergent is present in the washing liquor in order to release the dirt. In this case, for example, a further metering of detergent can be carried out by means of an automatic metering system as a specified action.

In this manner, a plurality of different indicators can be derived and in each case trigger a specified action on the basis of the temporal functional value of an individual sensor signal or on the basis of a plurality of temporal functional values of different sensor signals. As a whole, the operation of the dishwasher is improved thereby.

According to a further embodiment, the ascertaining unit is arranged in a facility which is external to the dishwasher, wherein the dishwasher and the external facility in each case have a communication unit for bidirectional communication.

In this embodiment, a greater computing power is preferably available to the ascertaining unit than if the ascertaining unit were to be integrated in the dishwasher. Thus more complex calculations can be carried out, which permits more accurate results.

The communication unit comprises, in particular, a modem, in particular a mobile communication modem and/or a network adapter.

The external facility in which the ascertaining unit is arranged can be a computer of the user or even a server on the Internet or the like. The communication connection can be a direct connection or a switched connection which is connected via one or more interposed appliances, such as for example a router. In this case, different technologies and/or communication protocols can be used for different sections of a connection. The communication connection can also be established as wired and/or wireless in some sections. Examples thereof are Bluetooth®, WLAN, LAN, Firewire, Zig-Bee, mobile communications (2G, 3G, LTE/4G 5G) and the like. The communication can be, in particular, protected cryptographically.

In embodiments, the dishwasher has both an ascertaining unit and an ascertaining unit is additionally arranged in the external facility. In this case, for example, simple ascertaining can be carried out locally and/or the local ascertaining unit takes over the ascertaining when a communication with the external facility is interrupted.

According to a second aspect, a method is proposed for operating a dishwasher, preferably a household dishwasher. The dishwasher comprises a control device for carrying out a washing program for washing items to be washed arranged in a washing chamber of the dishwasher. In a first step, a time curve of at least one sensor signal of a washing liquor is detected. In a second step, the time curve of the at least one sensor signal is stored. In a third step, a temporal functional value is ascertained on the basis of the time curve of the at least one sensor signal. In a fourth step, a specified action is carried out as a function of the ascertained temporal functional value.

This method has the same advantages as the system of the first aspect. The embodiments and features described relative to the proposed system accordingly apply to the proposed method.

Also proposed is a computer program product which comprises commands which, when the program is executed by a computer, cause the computer to execute the above-described method.

A computer program product, such as for example a computer program means, can be provided or delivered, for example, as a storage medium, such as for example a memory card, USB stick, CD-ROM, DVD or also in the form of downloadable file from a server in a network. This can be carried out, for example, in a wireless communication network by the transmission of a corresponding file by the computer program product or the computer program means.

Further possible implementations of the invention also include not explicitly mentioned combinations of features or embodiments described above or below relative to the exemplary embodiments. In this case, the person skilled in the art will also add individual aspects as improvements or additions to the respective basic form of the invention.

Further advantageous embodiments and aspects of the invention form the subject matter of the subclaims and the exemplary embodiments of the invention described below. The invention is described in more detail hereinafter by way of preferred embodiments with reference to the accompanying figures.

Elements which are the same or functionally the same have been provided in the figures with the same reference characters unless specified otherwise.

Figure 1:
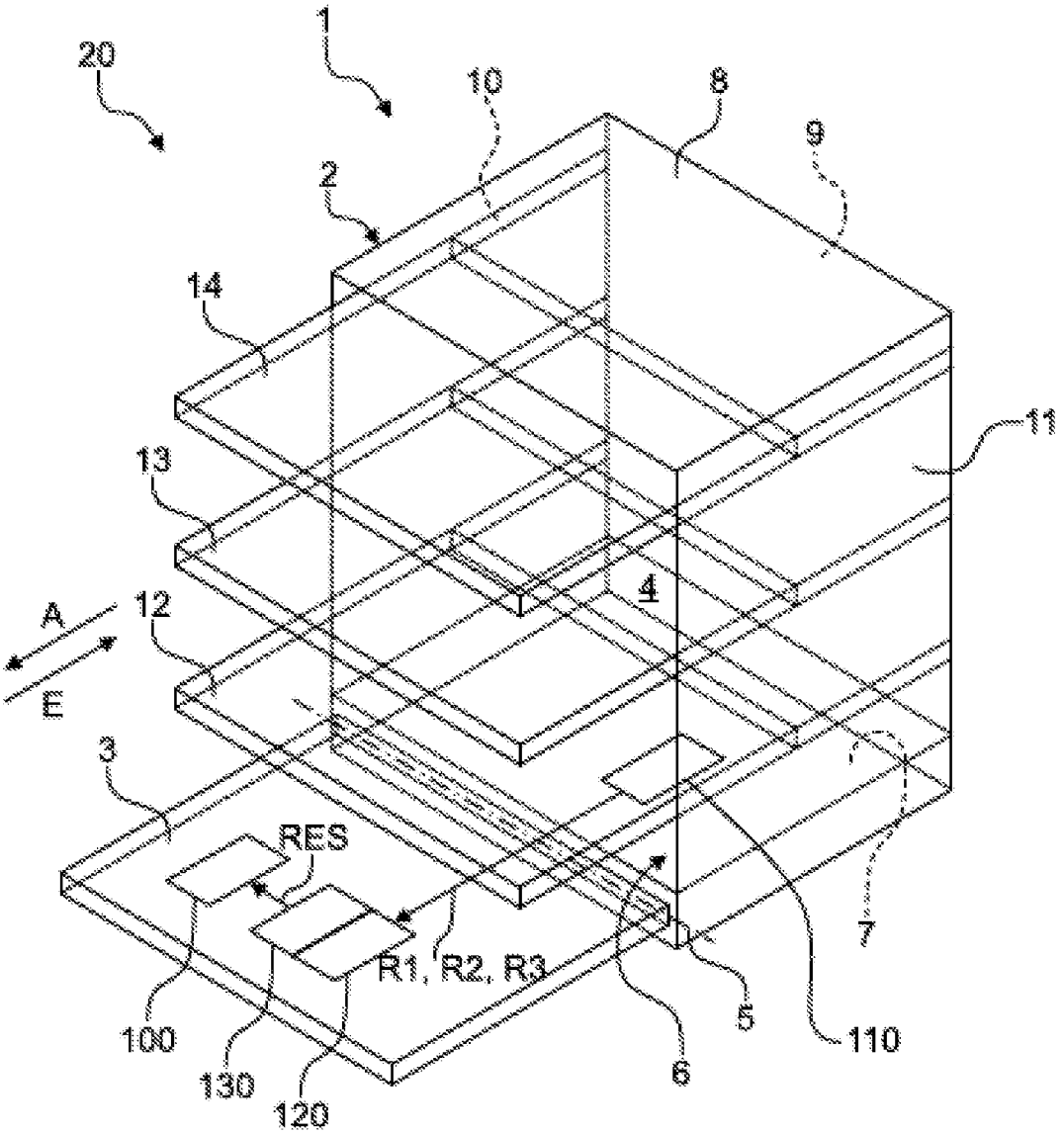
FIG. 1 shows a schematic perspective view of an embodiment of a system with a dishwasher.

FIG. 1 shows a schematic perspective view of a system 20 comprising a dishwasher 1 which is configured here as a household dishwasher. The household dishwasher 1 comprises a dishwasher cavity 2 which can be closed by a door 3, in particular in a water-tight manner. To this end, a sealing facility can be provided between the door 3 and the dishwasher cavity 2. The dishwasher cavity 2 is preferably cuboidal. The dishwasher cavity 2 can be arranged in a housing of the household dishwasher 1. The dishwasher cavity 2 and the door 3 can form a washing chamber 4 for washing items to be washed.

The door 3 is shown in FIG. 1 in the open position thereof. The door 3 can be closed or opened by pivoting about a pivot axis 5 provided at a lower end of the door 3. A loading opening 6 of the dishwasher cavity 2 can be closed or opened by means of the door 3. The dishwasher cavity 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 can be produced, for example, from a stainless steel sheet. The bottom 7 can be produced alternatively from a plastic material, for example.

The household dishwasher 1 also has at least one receptacle for items to be washed 12 to 14. Preferably, a plurality of receptacles for items to be washed 12 to 14, for example three thereof, can be provided, wherein the receptacle for items to be washed 12 can be a lower receptacle for items to be washed or a lower basket, the receptacle for items to be washed 13 can be an upper receptacle for items to be washed or an upper basket, and the receptacle for items to be washed 14 can be a cutlery drawer. As FIG. 1 also shows, the receptacles for items to be washed 12 to 14 are arranged one above the other in the dishwasher cavity 2. Each receptacle for items to be washed 12 to 14 can be displaced selectively into or out of the dishwasher cavity 2. In particular, each receptacle for items to be washed 12 to 14 can be pushed into or moved into the dishwasher cavity 2 in a push-in direction E and pulled out or moved out of the dishwasher cavity 2 in a pull-out direction A counter to the push-in direction E.

A sensor unit 110 which comprises at least one sensor for detecting a sensor signal SS (see FIGS. 2, 3, 4) of the washing liquor is arranged on the bottom 7. The sensor unit 110 preferably comprises a turbidity sensor, a conductivity sensor and a temperature sensor. The sensor unit 110 can also comprise further sensors, such as a water hardness sensor and/or a chemical sensor which is designed to detect a chemical composition of the active detergent released in the washing liquor or the dirt released in the washing liquor. A control device 100, a memory unit 120 and an ascertaining unit 130 are also arranged on the door 3. The sensor unit detects a time curve R1, R2, R3 of the sensor signal SS and transmits this time curve to the memory unit 120 which stores it. The ascertaining unit 130 accesses the stored time curve R1, R2, R3, ascertains a temporal functional value RES on the basis thereof and transmits this to the control device 100. The control device 100 is designed to carry out a specified action as a function of the temporal functional value RES. This is described in more detail in examples by way of FIGS. 2-5.

Figure 2:
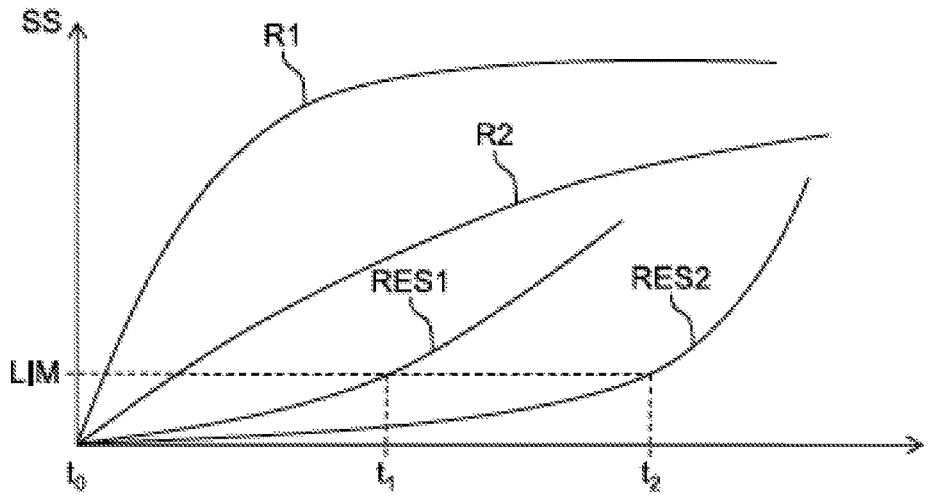
FIG. 2 shows a schematic diagram of a time curve of a sensor signal and a corresponding temporal functional value.

FIG. 2 shows a schematic diagram with two time curves R1, R2 of a sensor signal SS and two corresponding temporal functional values RES1, RES2. In this case, for example, it refers to one respective time curve R1, R2 of the conductivity sensor signal SS of a conductivity sensor and the integral of the respective time curve R1, R2 as the temporal functional value RES1, RES2. The time curves R1, R2 shown have been detected and stored, for example, in different washing program cycles and are superimposed in this diagram for better comparison. The horizontal axis shows a time t and the vertical axis shows the amplitude of the sensor signal SS, wherein a greater amplitude corresponds here to a higher conductivity.

At the time t0, for example, detergent is added to the washing liquor, whereupon the conductivity of the washing liquor rises. The time curve R1 corresponds, for example, to detergent powder and the time curve R2 corresponds, for example, to a detergent tab. The powder is more rapidly dissolved, which is why the conductivity rises significantly more rapidly than in the tab. Thus in the case of the powder, the temporal functional value RES1 rises significantly and considerably earlier than the temporal functional value RES2 in the case of the tab. The temporal functional value RES1, RES2 corresponds, for example, to a chemical work carried out by the detergent. For example, the items to be washed are clean as soon as the temporal functional value RES1, RES2 reaches a predetermined threshold value LIM. In the case of the powder, this is at a time t1 which is an earlier time than the time t2 in the case of the tab. Thus in the case of the powder, it is already possible at the time t1 to pass to the next sub-program step, for example a rinsing with rinse aid, which saves time and energy.

Figure 3:
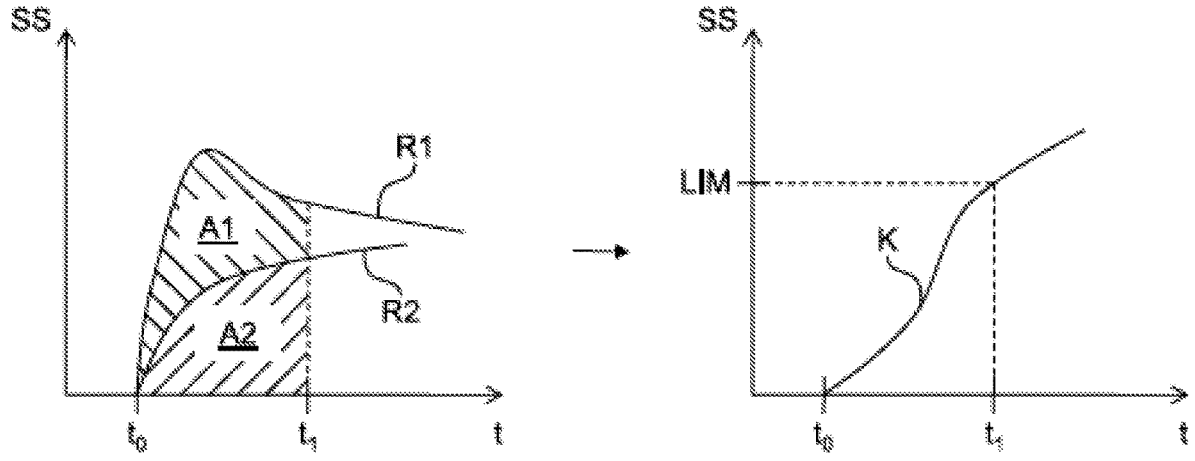
FIG. 3 shows a further schematic diagram of two time curves of two sensor signals and one respective temporal functional value and a schematic diagram of a curve of a key figure.

FIG. 3 shows a further schematic diagram of two time curves R1, R2 of two sensor signals SS (left-hand diagram) and a schematic diagram of a curve of a key figure K (right-hand diagram).

The horizontal axis shows in each case a time t and the vertical axis shows the amplitude of the sensor signal SS (left-hand diagram) and the value of the key figure K (right-hand diagram). The time curve R1 shows, for example, a temperature sensor signal and thus the temperature of the washing liquor, wherein at the time t0 a heating is started. The time curve R2 shows, for example, a turbidity sensor signal and thus the turbidity of the washing liquor, wherein at the time t0 the circulation of the washing liquor is started. The temperature rises up to a target value and then the heating is terminated which is why the temperature then drops again. The turbidity rises significantly at the start since a large quantity of dirt is released, wherein the slope slowly drops since the items to be washed become increasingly clean, so that less new dirt can be released. The areas A1, A2 of the respective time curve R1, R2 up to a time t1 are also shown in the diagram. The area A1, A2 results as the integral over the time t of the respective time curve R1, R2 and corresponds to a temporal functional value RES (see FIG. 1 or 6) of the respective time curve R1, R2. The area A1 corresponds, for example, to a thermal cleaning power of the washing liquor and the area A2 corresponds to a released quantity of dirt.

The key figure K is ascertained on the basis of the respective temporal functional value RES, which is provided here by the areas A1 and A2. The key figure K in this example is ascertained, for example, as the sum of the two areas A1, A2, wherein weighting factors a, b are also taken into consideration, as shown in the following equation (2):

$$a.\ K=a\cdot A1+b\cdot A2 \qquad \text{Equation (2)}$$

At the time t1 the key figure K reaches a specified threshold value LIM, from which it is inferred, for example, that the items to be washed are clean. Thus at this time t1, the washing program can be terminated or it is possible to pass to the next sub-program step of the washing program.

Figure 4:
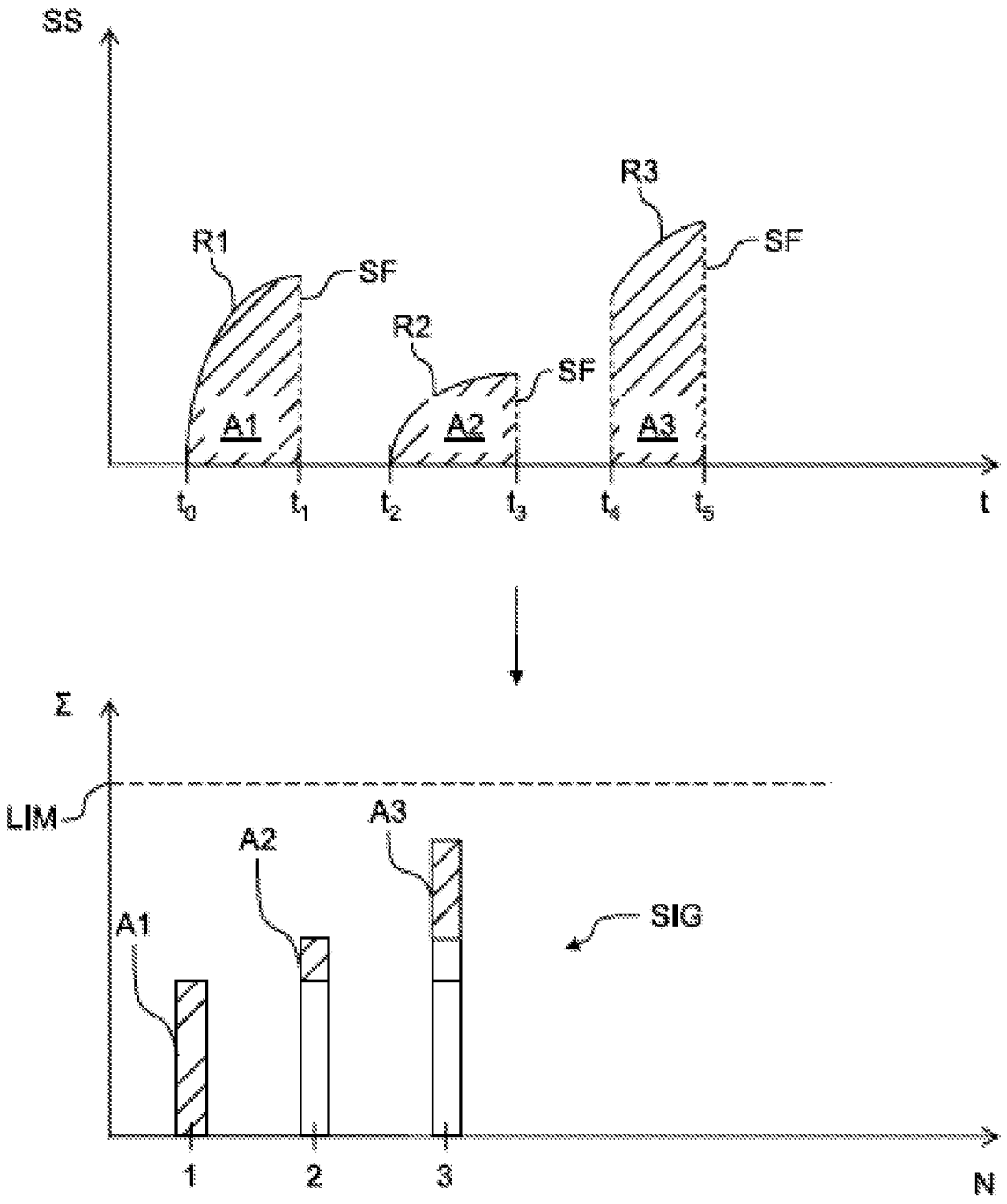
FIG. 4 shows a further schematic diagram of a time curve of a sensor signal over a plurality of washing program cycles, with an assigned washing program functional value and a schematic diagram of a curve of a washing program functional value.

FIG. 4 shows a further schematic diagram of a time curve R1, R2, R3 of a sensor signal SS over a plurality of washing program cycles with the assigned washing program functional value SF (upper diagram) and a schematic diagram of a curve of a washing program functional value SIG1 (lower diagram).

The upper diagram shows the time curve R1, R2, R3 of a sensor signal SS, for example a turbidity sensor, over three washing program cycles. The first washing program cycle starts at the time t0 and terminates at the time t1. The second washing program cycle starts at the time t2 and terminates at the time t3. The third washing program cycle starts at the time t4 and terminates at the time t5. The time integral which has the values A1, A2, A3 is formed from the respective time curve R1, R2, R3 as the washing program functional value SF. These values correspond, for example, to the quantity of dirt which has been washed out by the dishwasher 1 in one respective washing program cycle (see FIG. 1 or 6).

The curve of the washing program functional value SIG1 is formed on the basis of the washing program functional values SF, in this example this corresponds to the sum of the washing program functional values SF of the previous washing program cycles and is shown in the lower diagram. The horizontal axis N displays here the washing program cycles carried out and the vertical axis E displays the value of the curve of the washing program functional value SIG1. The curve of the washing program functional value SIG1 corresponds to the total quantity of dirt which has been washed off by the dishwasher 1. After a specified total quantity of dirt which is ascertained, for example, as a predetermined threshold value LIM, a machine cleaning program is carried out in order to prevent the components of the dishwasher 1 from being soiled, which could lead to an unhygienic state and/or a reduced cleaning performance.

Figure 5:
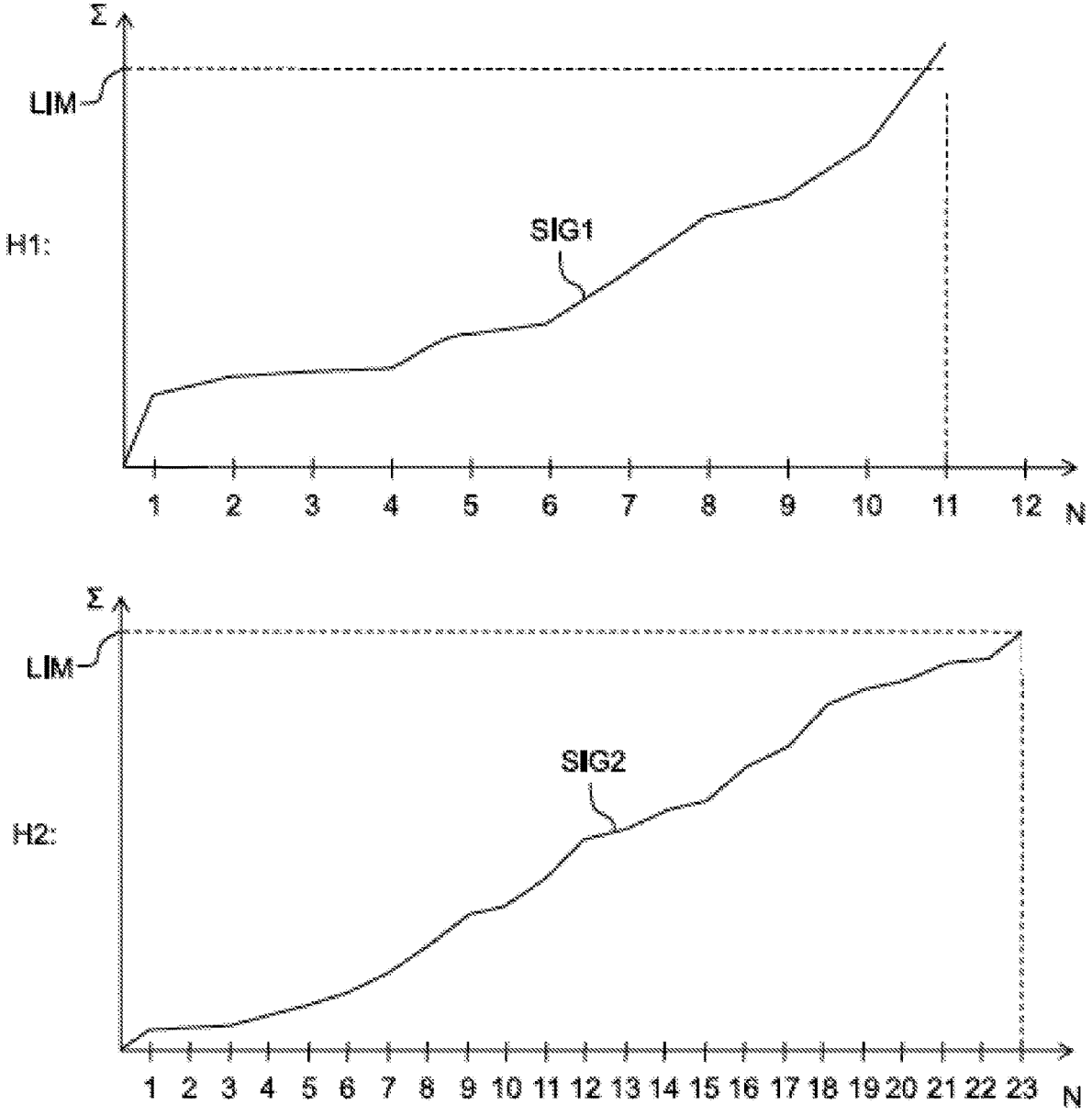
FIG. 5 shows two schematic diagrams of a curve of washing program functional values for different households.

FIG. 5 shows two schematic diagrams of a curve of washing program functional values SIG1, SIG2 for different households H1, H2. The horizontal axis N displays here the washing program cycles carried out and the vertical axis E displays the respective value of the curve of the washing program functional value SIG1, SIG2. The curves shown are, for example, the curve of the washing program functional value SF (see FIG. 4) of a turbidity sensor, as described using FIG. 4.

In this example, it can be seen that the triggering of a machine cleaning program on the basis of the curve of the washing program functional value SIG1, SIG2 can be different for different households H1, H2 when the statistics of the turbidity sensor differ. This can be the case, for example, when in one of the households, in the present case for example household H2, the washware is prewashed before it is placed in the dishwasher, but not in the other household H1. In the upper diagram, the threshold value LIM is already reached after 11 washing program cycles, but in the lower diagram the threshold value LIM is only reached after 23 washing program cycles.

Instead of the curve of the washing program functional value SIG1, SIG2 the statistic which is ascertained on the basis of the plurality of washing program functional values SF can also be present, for example a weighted sum of a plurality of washing program functional values SF, as specified in the equation (1).

Figure 6:
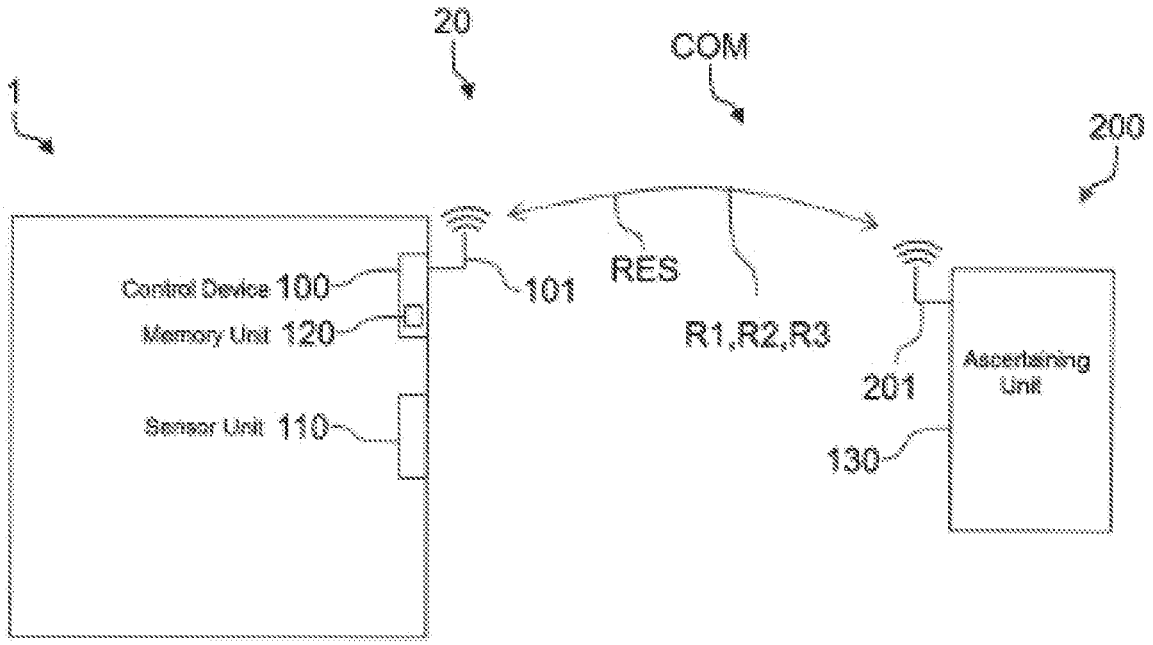
FIG. 6 shows a schematic block diagram of a system with a dishwasher.

FIG. 6 shows a schematic block diagram of a system 20 with a dishwasher 1, for example the household dishwasher of FIG. 1, and with an external facility 200. The dishwasher 1 comprises a communication unit 101, which is configured here as a mobile communication modem and which is coupled to the control device 100. The memory unit 120 is integrated here in the control device 100. The external facility 200 comprises in this example the ascertaining unit 130 and also has a communication unit 201. A communication connection COM can be established between the two communication units 101, 201. The control device 100 transmits to the ascertaining unit 130, for example, the time curves R1, R2, R3 which have been detected by the sensor unit 110. This ascertaining unit ascertains at least one temporal functional value RES and transmits this to the control device 100 via the communication connection COM. Additionally, the ascertaining unit 130 can ascertain a key figure K (see FIG. 3), a washing program functional value SF (see FIG. 4), a curve of a washing program functional value SIG1, SIG2 (see FIG. 4 or 5) and/or a statistic and transmit these values to the control device 100. The control device 100 carries out a specified action as a function of the temporal functional value RES, the key figure K, the washing program functional value SF, the curve of the washing program functional value SIG1, SIG2 and/or the statistic, in particular a machine care program or cleaning program.

Figure 7:
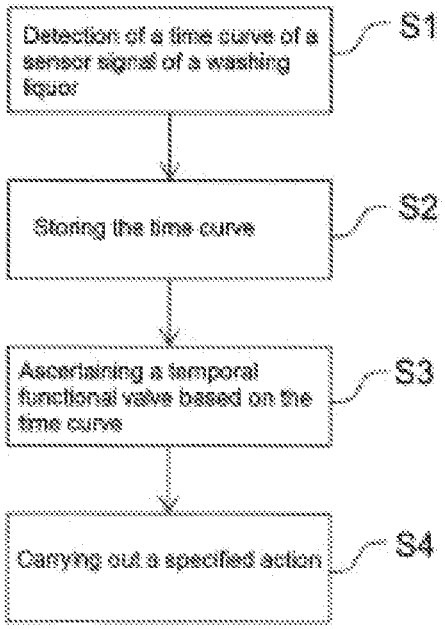
FIG. 7 shows a schematic block diagram of an exemplary embodiment of a method for operating a dishwasher.

FIG. 7 shows a schematic block diagram of an exemplary embodiment of a method for operating a dishwasher 1, for example the household dishwasher 1 of FIG. 1 or FIG. 6. In a first step S1, a time curve R1, R2, R3 (see FIG. 1, 2, 3, 4 or 6) of at least one sensor signal SS (see FIG. 2, 3 or 4) of a washing liquor is detected. In a second step S2, the time curve R1, R2, R3 of the at least one sensor signals SS is stored. In a third step S3, a temporal functional value RES, RES1, RES2 (see FIG. 1, 2 or 6) is ascertained on the basis of the time curve R1, R2, R3 of the at least one sensor signal SS. In a fourth step S4, a specified action is carried out as a function of the ascertained temporal functional value RES, RES1, RES2. The specified action comprises adapting a washing program parameter of a currently running washing program, carrying out a machine cleaning program and/or outputting a warning signal to a user of the dishwasher 1.

Figure 8:
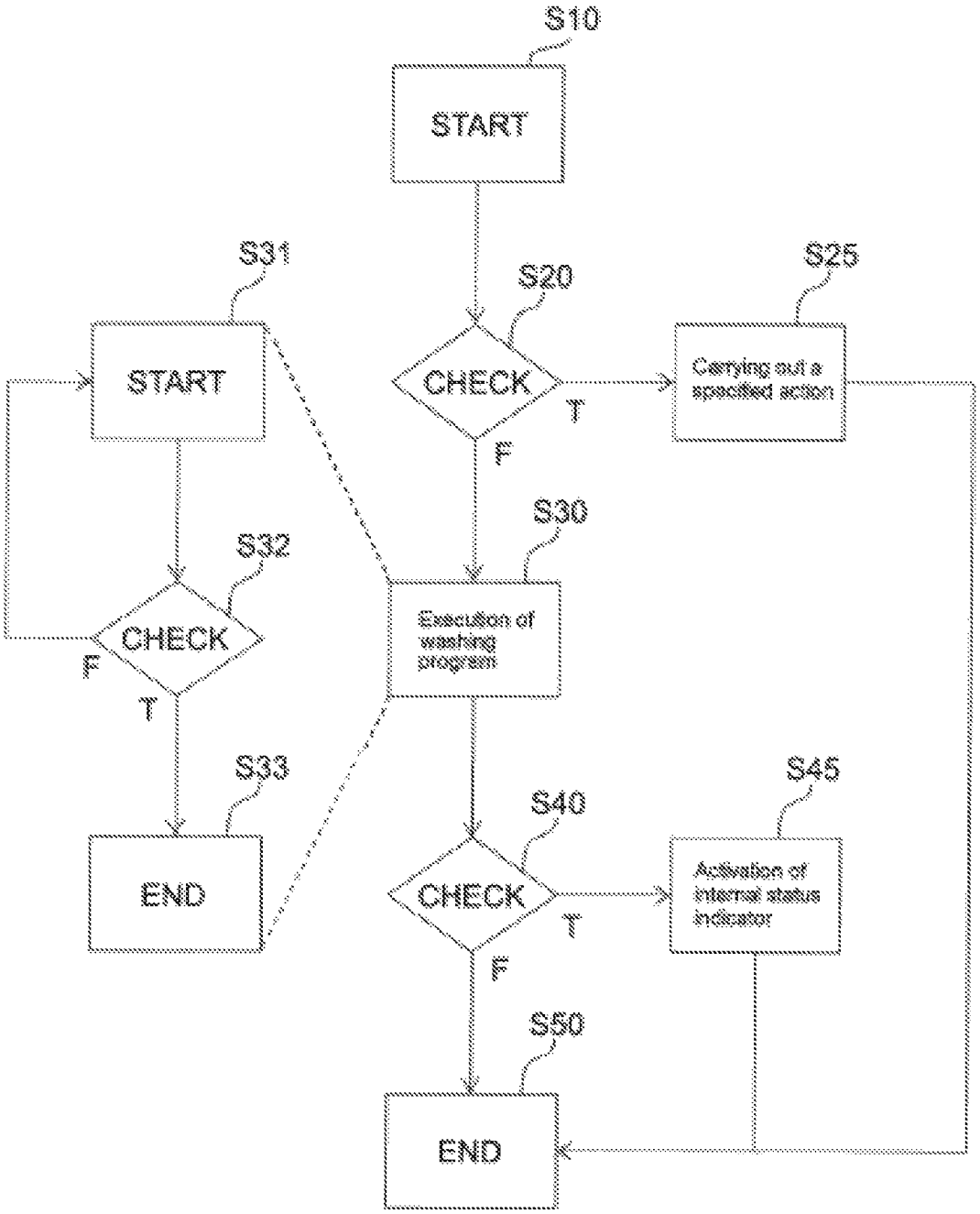
FIG. 8 shows a schematic block diagram of a further exemplary embodiment of a method for operating a dishwasher.

FIG. 8 shows a schematic block diagram of a further exemplary embodiment of a method for operating a dishwasher 1, for example the household dishwasher of FIG. 1 or FIG. 6. In a first step S10, the dishwasher 1 is switched on or a washing program is started. In a second step S20, for example, an internal status indicator is queried as to whether a machine cleaning program should be carried out. If this query results in "logically true" T, a machine cleaning program is carried out S25 or it is proposed to the user to start such a machine cleaning program. After the machine cleaning program S25, the program, for example, is terminated 550.

If the query results in "logically false" F, the execution of the washing program S30 is started. The washing program S30 comprises, for example, the sub-steps S31, S32, S33. The step S31 corresponds to the start of a loop which, for example, runs continuously during the execution of the washing program S30. For example in step S31, a time curve R1, R2, R3 (see FIG. 1, 2, 3, 4 or 6) of a sensor signal SS (see FIG. 2, 3 or 4) is detected and stored. In step S32, a temporal functional value RES (see FIG. 1, 2 or 6) is ascertained on the basis of the stored time curve R1, R2, R3 of the sensor signal SS and compared with a predetermined threshold value LIM (see FIG. 3, 4 or 5). If the threshold value LIM is exceeded, for example, logically true T is output, otherwise logically false F. In the case of logically false F, the loop begins again. In the case of logically true T, the loop is terminated S33, for example then passing to the next sub-program step.

After the elapse of the washing program cycle S30 a further query S40 follows in which, for example, a curve of a washing functional value SIG1, SIG 2 (see FIG. 4 or 5) is updated and it is ascertained whether a threshold value LIM is exceeded. If this is the case (logically true T), the internal status indicator is activated S45, for example, or another specified action is carried out. If this is not the case (logically false F), the washing program cycle is terminated 550.

While the present invention has been described with reference to exemplary embodiments, it can be modified in many different ways.

REFERENCE CHARACTERS USED

1 Dishwasher
2 Dishwasher cavity
3 Door
4 Washing chamber
Pivot axis
6 Loading opening
7 Bottom
8 Ceiling
9 Rear wall
10 Side wall
11 Side wall
12 Receptacle for items to be washed
13 Receptacle for items to be washed
14 Receptacle for items to be washed
15 System
100 Control device
101 Communication unit
110 Sensor unit
120 Memory unit
130 Ascertaining unit
200 External facility
201 Communication unit
A Pull-out direction
A1 Integral
A2 Integral
A3 Integral
E Push-in direction
F Logically false
H1 Household
H2 Household
K Key figure
LIM Threshold value
R1 Time curve
R2 Time curve
R3 Time curve
RES Temporal functional value
RES1 Temporal functional value
RES2 Temporal functional value
S1 Method step
S2 Method step
S3 Method step
S4 Method step
S10 Method step
S20 Method step
S25 Method step
S30 Method step
S31 Method step
S32 Method step
S33 Method step
S40 Method step
S45 Method step
550 Method step
SF Washing program functional value
SIG1 Curve of washing program functional value
SIG2 Curve of washing program functional value
SS Sensor signal
T Logically true
t0 Time
t1 Time
t2 Time
t3 Time
t4 Time
t5 Time

The invention claimed is:

1. A system, comprising:

a dishwasher including a washing chamber;

a sensor unit comprising at least two of a member selected from a group consisting of a turbidity sensor, a conductivity sensor, a temperature sensor, and a filter soiling sensor, with each member configured to detect a time curve of a sensor signal of a washing liquor, wherein the sensor unit is configured to output the detected time curves of at least two sensor signals;

a memory unit designed to store the time curves of the at least two sensor signals;

an ascertaining unit designed to ascertain a temporal functional value based on the time curves of the at least two sensor signals, wherein the temporal functional value comprises at least two integral values, and wherein the ascertaining unit is designed to integrate the time curves of the at least two sensor signals to ascertain the at least two integral values, and wherein the ascertaining unit is further designed to ascertain a key figure based on the at least two integral values; and a control device designed to carry out a washing program for washing washware in the washing chamber of the dishwasher and to carry out a specified action as a function of the ascertained key figure.

2. The system of claim 1, wherein the dishwasher is embodied as a household dishwasher.

3. The system of claim 1, wherein the turbidity sensor is configured to detect a turbidity of the washing liquor, wherein the conductivity sensor is configured to detect a conductivity of the washing liquor, and wherein the temperature sensor is configured to detect a temperature of the washing liquor.

4. The system of claim 3, wherein the turbidity sensor is an optical turbidity sensor.

5. The system of claim 3, wherein the conductivity sensor is a spectroscopic impedance sensor.

6. The system of claim 1, wherein the sensor unit comprises the turbidity sensor for detecting the turbidity of the washing liquor, the conductivity sensor for detecting a conductivity of the washing liquor, and the temperature sensor for detecting the temperature of the washing liquor.

7. The system of claim 1, wherein the filter soiling sensor is designed to detect a degree of soiling of the filter arranged in the dishwasher and to output the detected degree of soiling as a further sensor signal.

8. The system of claim 1, wherein the ascertaining unit is designed to differentiate a time curve of at least one sensor signal to ascertain a differential value, said control device designed to carry out the specified action as a function of the ascertained differential value.

9. The system of claim 1, wherein ascertaining unit is designed to ascertain a washing program functional value as a function of a stored time curve of at least one sensor signal for a washing program cycle, to store the washing program functional value and to ascertain a curve of the washing program functional value based on the washing program functional value over a plurality of washing program cycles, said control device designed to carry out the specified action as a function of the ascertained curve of the washing program functional value.

10. The system of claim 9, wherein the ascertaining unit is designed to ascertain a washing program functional value as a function of the stored time curve of the signal of the at least two sensor signals for the washing program cycle, to store a respective value of the at least two washing program functional values and to ascertain a statistic based on a respective curve of at least two washing program functional values over the plurality of washing program cycles, said control device designed to carry out the specified action as a function of the ascertained statistic.

11. The system of claim 9, wherein the control device is designed to carry out a machine care program and/or a filter cleaning program as a function of the temporal functional value and/or the curve of the washing program functional value.

12. The system of claim 1, wherein the control device is designed to adapt a current washing program to shorten a sub-program step of the current washing program as a function of the temporal functional value.

13. The system of claim 12, wherein the control device is designed to adapt the current washing program by shortening the sub-program step of the current washing program.

14. The system of claim 1, further comprising a facility which is external to the dishwasher and which comprises the ascertaining unit, the dishwasher and the facility each including a communication unit for bidirectional communication.

15. A method for operating a dishwasher which includes a control device for carrying out a washing program for washing washware arranged in a washing chamber of the dishwasher, said method comprising:

detecting time curves of at least two sensor signals of a washing liquor with a sensor unit comprising at least two of a member selected from a group consisting of a turbidity sensor, a conductivity sensor, a temperature sensor, and a filter soiling sensor, with each member detecting a time curve of a sensor signal of the washing liquor;

storing the time curves of the at least two sensor signals;

ascertaining a temporal functional value including at least two integral values based on the time curves of the at least two sensor signals by integrating the time curves of the at least two sensor signals to ascertain the at least two integral values;

ascertaining a key figure based on the at least two integral values; and carrying out with the control device a specified action as a function of the ascertained key figure.

16. The method of claim 15, wherein the dishwasher is a household dishwasher.

17. A computer program product, comprising a computer program embodied in a non-transitory computer-readable medium and comprising commands which, when the computer program is executed by a computer, cause the computer to:

detect, with a sensor unit comprising at least two of a member selected from a group consisting of a turbidity sensor, a conductivity sensor, a temperature sensor, and a filter soiling sensor, time curves of at least two sensor signals of a washing liquor in a washing chamber of a dishwasher;

store the time curves of the at least two sensor signals;

ascertain a temporal functional value comprising at least two integral values based on the time curves of the at least two sensor signals by integrating the time curves of the at least two sensor signals to ascertain the at least two integral values;

ascertain a key figure based on the at least two integral values; and carry out, via a control device, a specified action as a function of the ascertained key figure.

* * * * *